US006796928B1

(12) United States Patent
Christopher et al.

(10) Patent No.: US 6,796,928 B1
(45) Date of Patent: Sep. 28, 2004

(54) FOOT AND LOWER LEG EXERCISE APPARATUS

(76) Inventors: Gilman O. Christopher, 924 W. 11th Pl., Mesa, AZ (US) 85201; John G. Bulla, 2085 W. Harbor Dr., Chandler, AZ (US) 85248

( * ) Notice: Subject to any disclaimer, the term of this patent is extended or adjusted under 35 U.S.C. 154(b) by 178 days.

(21) Appl. No.: 10/274,549

(22) Filed: Oct. 21, 2002

(51) Int. Cl.[7] ..... A63B 22/00
(52) U.S. Cl. ..... 482/51; 482/52; 482/123
(58) Field of Search ..... 482/80, 146, 147, 482/51–53, 123, 79, 121, 71

(56) References Cited

U.S. PATENT DOCUMENTS 5,433,684 A * 7/1995 Carrillo ..... 482/80
5,453,065 A * 9/1995 Lien et al.
6,582,344 B2 * 6/2003 Tang

* cited by examiner

*Primary Examiner*—Jerome W. Donnelly
(74) *Attorney, Agent, or Firm*—H. Gordon Shields

(57) ABSTRACT

Foot and leg exercise apparatus includes a pair of pedals pivoting on a base element. At the front of the base is a vertical post and a tee element telescopes relative to the vertical post. The post and the element include aligned apertures for adjusting the height of the tee element relative to the post. A pin is inserted into the desired aligned apertures in the post and tee element at the desired height. Tension springs are secured to the tee element and to the pedals for moving the pedals upwardly. The user's feet are disposed on the pedals and the user's feet and legs are exercised by pivoting the pedals against the tension springs. By adjusting the height of the tee element, the force of the tension springs may be varied. Sets of tension springs of varying strength may be used progressively. For forced exercise, a motor and cams may be used to move the pedals downwardly against the upward biasing force of the tension springs.

19 Claims, 3 Drawing Sheets

FOOT AND LOWER LEG EXERCISE APPARATUS

BACKGROUND OF THE INVENTION

1. Field of the Invention

This invention relates to exercise apparatus for feet and lower legs, and more particularly, to apparatus for expanding and contracting calf muscles for pumping blood from the lower limbs to the heart using adjustable tension springs.

2. Description of the Prior Art

U.S. Pat. No. 3,295,847 (Matt) discloses a boxed exercise apparatus for feet in which springs are located at the front of a foot pad area. The foot pads are pivoted at their rear. Both tension and compression springs are disclosed.

U.S. Pat. No. 3,421,760 (Freeman) discloses another type of foot exercise apparatus using tension springs. A pair of foot elements are secured to a transverse bar and the transverse bar is secured to a pair of roller elements which move on a rail. Springs are secured to both ends of the foot elements.

U.S. Pat. No. 3,749,400 (Stoffel) discloses leg exercise apparatus which includes a foot element disposed within an elongated box. A tension springs opposes the user's efforts to move the foot element and thus provides the exercise for the user's leg.

U.S. Pat. No. 4,111,416 (Jinotti) discloses a leg exercise apparatus in which a foot pedal is pivoted at one end and a compression spring is disposed beneath the front end of the foot pedal to provide the resistance for the exercise of a user's leg or foot.

U.S. Pat. No. 4,422,635 (Herod et al) discloses another type of foot and leg exercise apparatus in which a butterfly spring is disposed beneath a foot element, and the foot element is pushed against the resistance of the butterfly spring.

U.S. Pat. No. 4,900,012 (Fu) discloses a leg exercise apparatus which includes a vertically extending frame with handle bar supports. The apparatus comprises essentially a small, compact, stair stepping exercise unit. Foot elements move on rods of the frame, and movement of the foot elements is opposed by compression springs beneath the foot elements.

U.S. Pat. No. 4,946,162 (Lubie) discloses the use of hydraulic cylinders in a foot exercise apparatus. Foot pedals are pushed against the force of the hydraulic cylinders.

U.S. Pat. No. 6,334,624 (Giglio) discloses foot and leg exercise apparatus usable by a person in a wheel chair. The user pushes against a shock absorbing element and tension springs are used as return elements for foot pedals secured to the shock absorbing elements.

SUMMARY OF THE INVENTION

The invention described and claimed herein comprises exercise apparatus for a user's feet and lower legs using tension springs secured to a tee element. The tee element telescopes within a bottom element. The bottom element extends into a center base element. A pair of foot pedals are pivotly secured to the base element remote from the bottom element and from the tee element. Tension springs are secured to the outer ends of the adjustable tee element. The tension springs are also secured to the foot pedals. Raising and lowering the tee element varies the force of the tension springs and accordingly varies the resistance for exercising a user's feet. An alternate embodiment includes a motor to move the foot pedals for providing forced exercising under certain circumstances.

Among the objects of the present invention are the following:

To provide new and useful exercise apparatus;

To provide new and useful foot and leg exercise apparatus;

To provide new and useful foot and leg exercise apparatus using tension springs;

To provide new and useful exercise apparatus including an adjustable element for varying the resistance of tension springs;

To provide new and useful apparatus for expanding and contracting calf muscles for pumping blood from a user's extremities to the user's heart;

To provide new and useful exercise apparatus having a motor to provide exercise for a user's feet and legs; and To provide new and useful exercise apparatus having a foldable support element for a pair of tension springs.

DESCRIPTION OF THE PREFERRED EMBODIMENT

Figure 1:
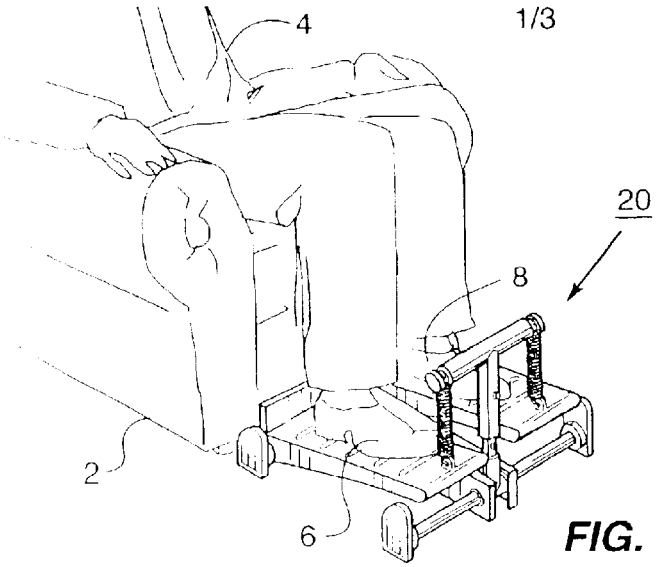
FIG. 1 is a perspective view of the apparatus of the present invention in its use environment.
Figure 2:
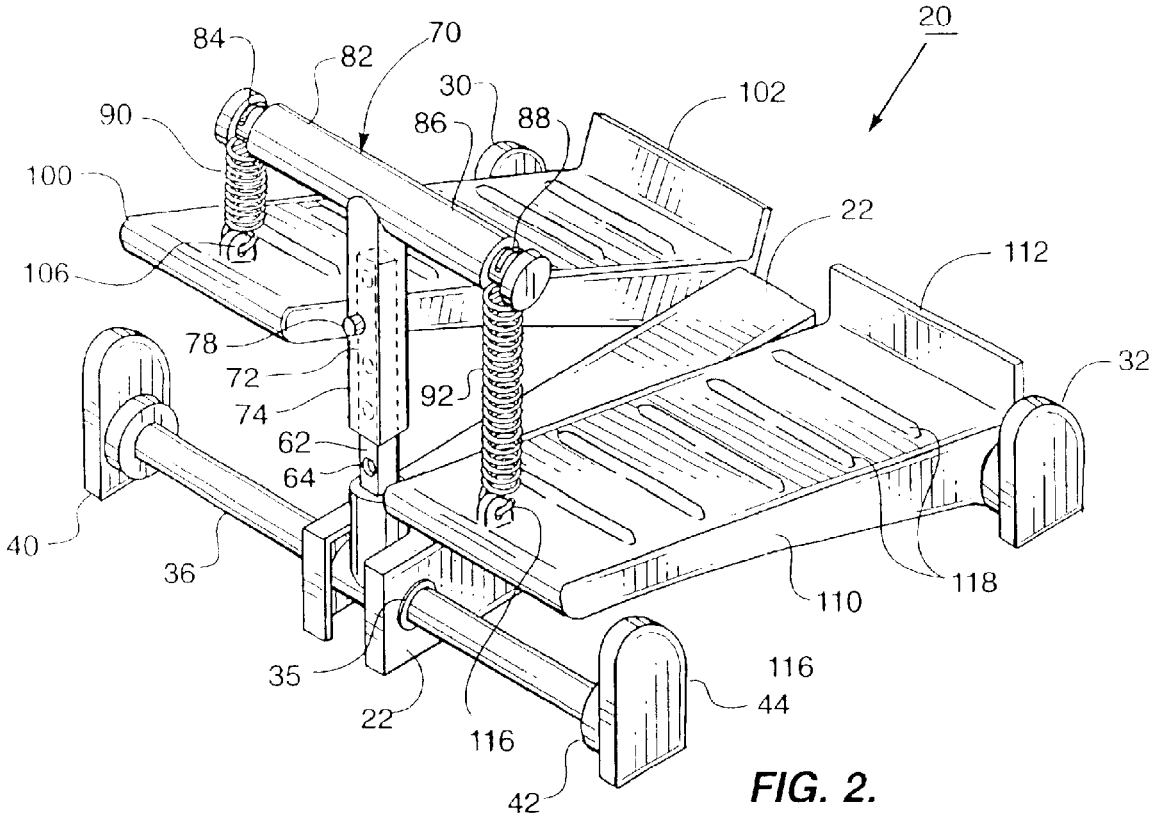
FIG. 2 is a front perspective view of the apparatus of the present invention.
Figure 3:
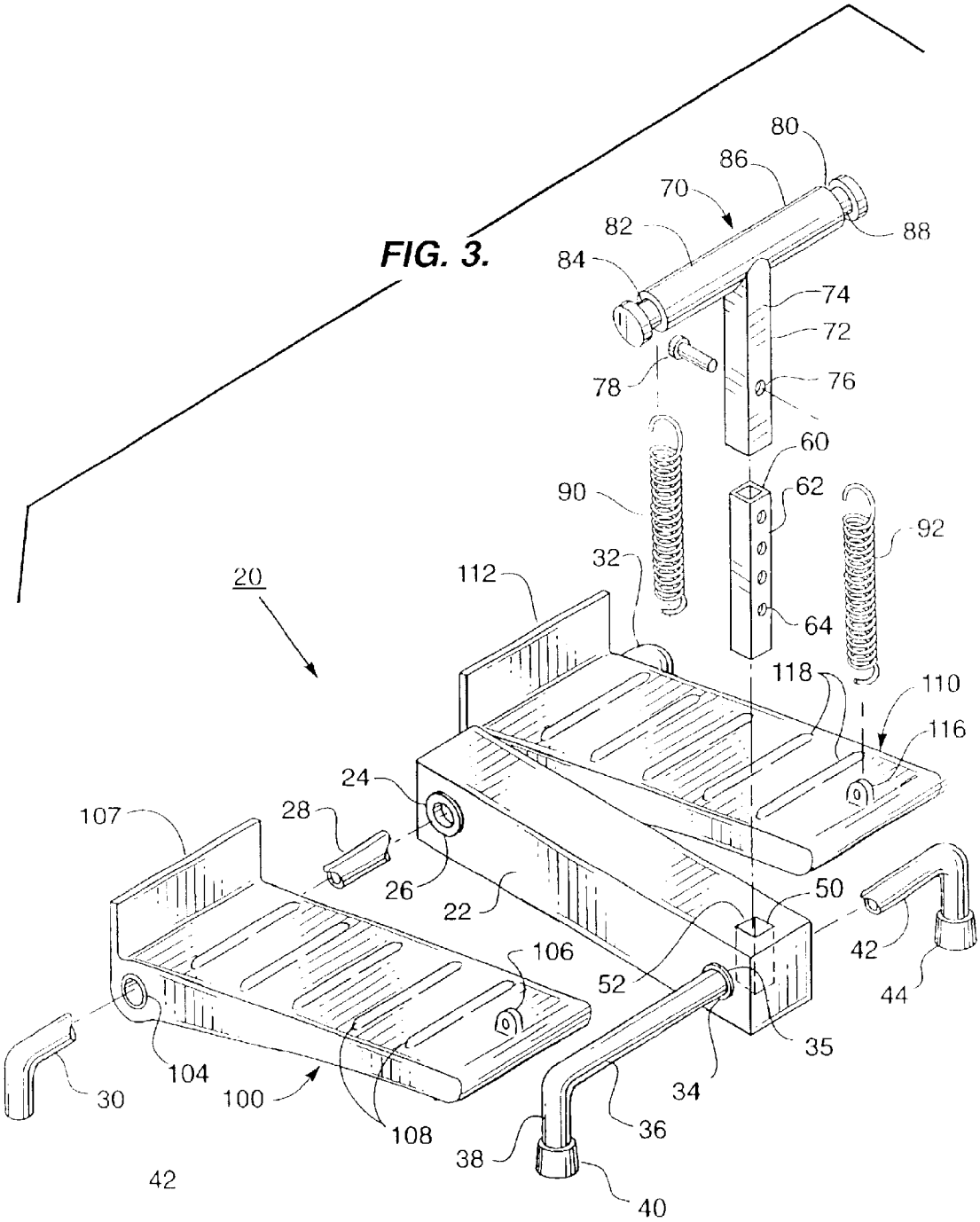
FIG. 3 is an exploded perspective view of exercise apparatus of the present

FIG. 1 is a perspective view of a portion of a user 4 sitting in a chair 2 with the user's feet 6 and 8 disposed on exercise apparatus 20 of the present invention. FIG. 2 is a front perspective view of the apparatus 20, and FIG. 3 is an exploded perspective view apparatus 20. For the following discussion, reference may be made to all three drawing Figures. It will be noted that while the present apparatus is referred to as exercise apparatus, the apparatus contracts and expands the user's calf muscles to pump blood from the lower extremities to the heart. Thus, in a sense the apparatus performs two functions, providing exercise against a resistance provided by tension springs and pumping blood from the lower extremities to the heart. For sedentary people, this apparatus provides much the same function as walking does for ambulatory people.

The exercise apparatus 20 includes a center base 22 which comprises a relatively slender and elongated block. At the rear of the base 22 is a transversely extending bore or aperture 24. A bushing 26 is shown disposed in the bore or aperture 24. A pivot rod 28 extends through the bushing 26 and the bore 24. At the outer ends of the rod 28 are a leg 30 and a leg 32. The legs 30 and 32 are generally L shaped, with outer ends extending downwardly and disposed on a floor for stability.

There is a front transversely extending bore or aperture 34 in which there is a bushing 35 and through which bushing extends a front support rod 36. At the distal ends of the rod 36 are legs 38 and 42. The legs 36 and 42 include tips 40 and 44, respectively. The tips 40 and 44 are preferably rubber or other appropriate material for providing frictional engagement for the apparatus 20 in order that the apparatus 20 remains in a generally fixed location for exercising.

At the front of the base 22, adjacent to the bore 34 is a vertical bore 50. The bore 50 includes a generally flat wall portion 52. A vertical post 60 is disposed in the bore 50. The post 60 includes a flat back portion 62 which is disposed against the wall portion 52 to orient the post properly, as will be explained below. The flat backs also prevent the post 50 from rotating on the base 22. A plurality of diametrically aligned and vertically spaced apertures 64 extend through the post 60. The apertures 64 allow height adjustments for varying the tension of springs, as will also be discussed below.

Extending into the post 60 is tee element 70. The tee element 70 includes a vertical portion 72 and a horizontal element 80. The vertical portion 72 includes a generally flat portion 74 which is disposed against the flat portion 62 of the post 60. Extending through the vertical element 72 is a pair of aligned apertures 76. The aperture pair 76 is aligned with a desired pair of apertures 64 and a pin 78 is inserted into the aligned aperture pairs 64, 76 in order to secure the tee element 70 at a desired height.

The horizontal element 80 is disposed on the top of the vertical portion 72. The horizontal element includes a pair of arms 82 and 86. The arm 82 includes a spring recess 84 and the arm 86 includes a spring recess 88. The spring recesses 84 and 88 receive upper ends of tension springs 90 and 92, respectively. The lower ends of the tension springs 90 and 92 extend to foot pedals 100 and 110, respectively. The foot pedals 100 and 110 include rear stop elements 102 and 112, respectively. The user's feet back up to the stop elements, as may be understood from FIG. 1. The stop elements 102 and 112 are essentially rear vertically extending elements whose purpose is to limit the rearward movement of, or to provide a rear support for, a user's feet as the user exercises on the apparatus 20.

The pedals 100 and 110 pivot on the rod 28 at the rear portion of the pedals. The rod 28 extends through aligned apertures or bores, of which a bore 104 for the pedal 100 is shown in FIG. 3. At the front of the pedals 100 and 110 are vertically extending spring anchor bosses 106 and 116, respectively. The anchor bosses 106 and 116 include apertures for receiving the lower ends of the tension springs 90 and 92, respectively.

The tension springs 90 and 92 provide an upward force or bias for the pedals to lift or pivot the front of the pedals 100 and 103, respectively, for a user. The user exerts a downward pivoting force against the force or bias of the tension springs to exercise the muscles of the lower legs and feet.

For storage and transport or shipping, the springs 90 and 92 are unhooked from either or both the pedals and the arms 82 and 86 of the tee element 70. The post 60 and the tee element 70 are compacted by lowering the tee element 70 to its lowest position on the post 60. The post 60 is then moved upwardly out of the bore 50. The post 60 and the tee element 70 combination and the springs 90 and 92 are then appropriately disposed generally parallel to the base 22 and the pedals 100 and 110.

Extending generally transversely across the pedals 100 and 110 are ribs 108 and 118, respectively. The purpose of the ribs 108 and 118 is to provide frictional engagement for the user's feet to insure that the feet do not slip off the pedals while the user is exercising. Of course, such ribs may be optional elements, and may be omitted if desired.

Figure 4:
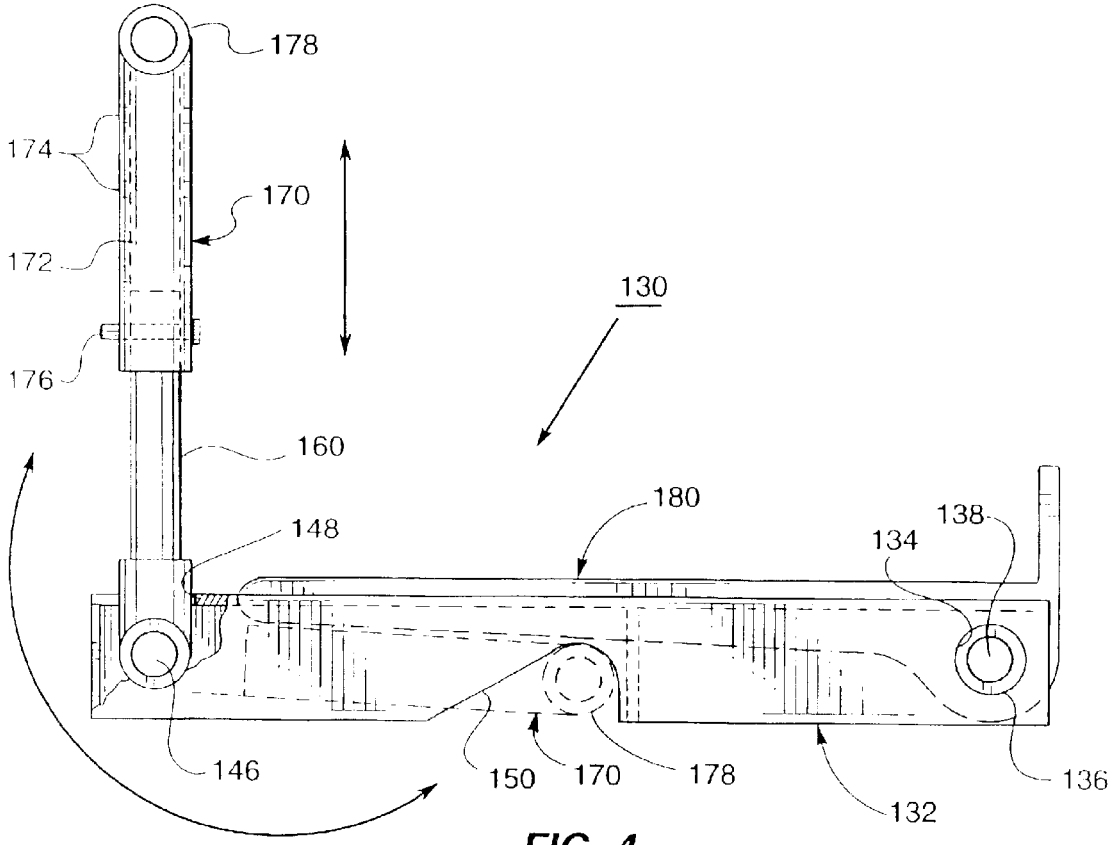
FIG. 4 is a side view of a portion of an alternate embodiment of the apparatus of the present invention.

FIG. 4 is a side view in partial section of an alternate embodiment feet and leg exercise apparatus 130. The apparatus 130 includes a center base element 132 and a rear bore 134 extends through the base 132. A bushing 136 is disposed in the bore 134 and a rear pivot rod 138 extends through the bushing 136. A pair of foot pedals, of which a pedal 180 is shown, is pivotly secured to the rod 138.

Generally parallel to the rear pivot rod 138 is a relatively short front rod 146. The rod 146 is disposed in a bore adjacent to a slot 148. Extending upwardly from the bottom of the base 132 is a bottom recess 150.

A spring support post 160 is pivotly disposed on the front rod 146. A tee element 170 telescopes on the support post 160. The tee element includes a vertical member 172 and a horizontal member 178. The vertical member 172 includes a plurality of aligned apertures 174, while the post 160 includes only a single pair of aligned apertures. For adjusting the height of the vertical member 172 and its horizontal member 178, to which are attached a pair of tension springs (not shown), a desired pair of the apertures 174 are aligned with the aperture pair in the post 160 and a pin 176 is inserted through the aligned apertures to fix the height of the tension springs.

For storing and transporting the apparatus 130, the springs (not shown in FIG. 4, but see FIGS. 1, 2, and 3) are removed from the horizontal member 178, and the post 160 and the tee element 170 are shortened to their lowest position. The post 160 and the tee element 170 are then pivoted on the rod 146 out of the slot 148 and the horizontal member 178 is disposed in the recess 150, as shown in phantom in FIG. 4. The pedals, of which the pedal 180 is shown in FIG. 4, are disposed on the nested horizontal member 178 of the tee element 170.

For appropriately exercising a user's feet and legs over a period of time, such as in a rehabilitative situation, it may be desirable to have springs of different strengths. For example, a user may have several sets of springs, such as, for example, three sets, one set of springs being light, one set being normal or intermediate, and one set being strong. A user may thus progress from one set of springs to another set during a period of rehabilitation. In the alternative, the spring sets may be varied for different feet and legs. For example, if the left leg and foot 8 of the user 4 is weaker than the right leg and foot 6, the spring 92 would be lighter than the spring 90. As the left leg and foot 8 gets stronger, a stronger spring 92 would be used. The springs in the sets of springs may thus be interchanged as required under the particular circumstances or needs of a user 4.

Figure 5:
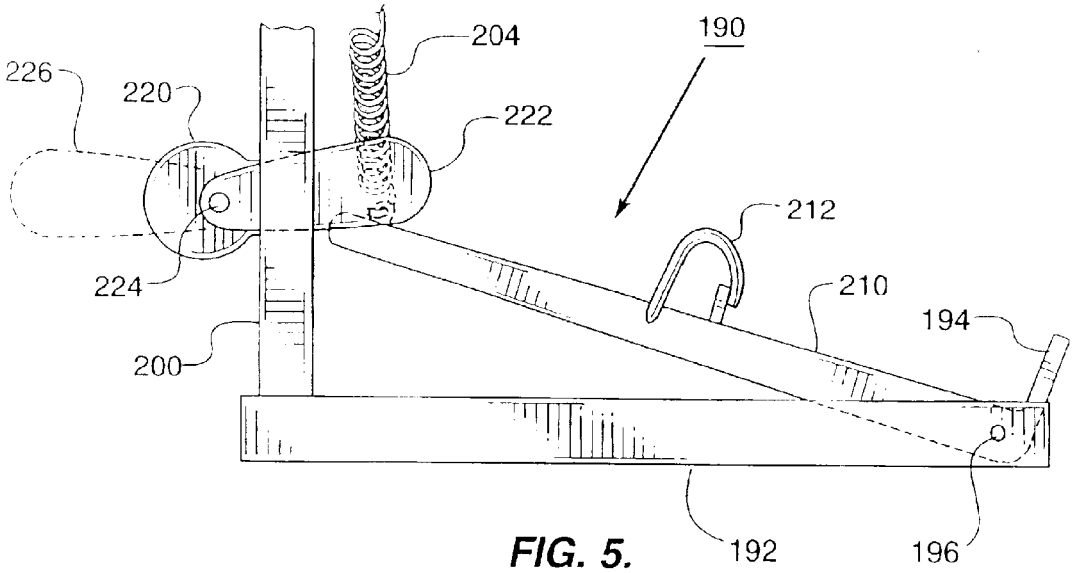
FIG. 5 is a side view of a portion of another alternate embodiment of the apparatus of the present invention.

FIG. 5 is a side view of a portion of another alternate embodiment of the present invention. A portion of a leg and foot exercise apparatus 190 is illustrated. The apparatus 190 includes generally the primary elements illustrated above in conjunction with the apparatus 20 and 130, but also includes a motor and a pair of cams or lobes at the front of the pedals in order to lower the pedals against the upward force or bias of tension springs. The apparatus 190 provides forced exercise for the feet and legs of someone who cannot, for some reason, cannot perform such exercise on their own initiative. Only one pedal of a pair of pedals is shown in FIG. 5, along with a single spring and an actuating cam for the pedal.

The apparatus 190 includes a center base 192 to which is secured a pedal 210 through a pivot rod 196. The pivot rod 196 is at the rear of the base 192, and a center post 200 is secured to the front portion of the base 192. A tee element, not shown, telescopes relative to the post 200 and a tension spring 204 extends from the tee element to the front portion of the pedal 210.

So far, the apparatus 190 is substantially the same as the apparatus 20, as discussed above. However, the apparatus 190 includes other elements not needed in the apparatus 20. A motor 220 is secured to the post 200, and a cam 222 is secured for rotation to an output shaft 224 of the motor. The cam 222 is disposed adjacent to the front portion of the pedal 210, and adjacent to the spring anchor boss on the pedal to which the lower portion of the spring 204 is secured.

As the output shaft 224 rotates at a relatively slow speed, the cam 222 bears against the pedal 210 and moves the front part of the pedal 210 downwardly against the upward bias of the tension spring 204. When the cam 222 moves away from the pedal 2 10, the spring 204 pivots the pedal upwardly. As the cam 222 continues to rotate, it again contacts the pedal 210 and pivots the pedal downwardly.

The pedal 210 thus pivots downwardly due to the cam 222 and the motor 220 and moves upwardly due to the force of the tension spring 204. A foot disposed on the pedal 210, and of course the leg to which the foot is connected, would thus be exercised even when the user could not exercise without the motor and cam embodiment 190. In order to secure a user's foot to the pedal 210 under the circumstances for which the apparatus 190 is appropriate, a fastener unit 212 is shown secured to the pedal 210. The fastener unit 212 may be any appropriate fastening means, such as a hook and loop fasteners secured to a pair of straps.

For the exercise apparatus 190, a pair of cams is secured to the shaft 224 of the motor 220, and the cams may be generally parallel or disposed one hundred eighty degrees apart, depending on whether simultaneous movement or alternate movement of the pair of pedals is desired. In FIG. 5, a second cam 226 for a second pedal not shown, is illustrated in dotted line. The cam 226 is shown disposed one hundred eighty degrees from the cam 222 on the shaft 224 of the motor 220. The one hundred eighty degree orientation of the cams provides alternate movement of the pedals of the exercise apparatus 190.

The apparatus of the present invention provides sedentary people the ability to increase blood circulation in the lower extremities by providing for the contraction and expansion of the calf muscles for pumping blood back to the heart. In a sense, the calf muscles may be considered as secondary heart muscles because their contraction and expansion cause blood to be pumped from the extremities to the heart. By varying the resistance for the calf muscles by using adjustable tension springs, sedentary people may provide the calf muscles with varying resistance for strengthening the calf muscles and may thus may increase the ability over a period of time to increase the effectiveness of the calf muscles.

While the principles of the invention have been made clear in illustrative embodiments, without departing from those principles there may occur to those skilled in the art modifications of structure, arrangement proportions, the elements, materials, and components used in the practice of the invention, and otherwise, which are particularly adapted to specific environments and operative requirements. The appended claims are intended to cover and embrace any and all such modifications within the limits only of the true spirit and scope of the invention.

What we claim is:

1. Exercise apparatus for a user's feet and legs comprising in combination:

a base element;

a first pedal pivotly secured to the base element;

a second pedal pivotly secured to the base element;

a post extending vertically on the base element remote from where the first and second pedals are pivotly secured to the base element;

a tee element vertically adjustable relative to the post said tee element including a vertically oriented section and a horizontally oriented section;

first tension spring disposed between, said horizontally extending section of the tee element and the first pedal to provide an upward bias force to move the first pedal upwardly; and a second tension spring disposed between the tee element and the second pedal to provide an upward bias force to move the second pedal upwardly.

2. The exercise apparatus of claim 1 in which the pedals include rear stop elements.

3. The exercise apparatus of claim 1 in which the post includes a plurality of pairs of aligned apertures, and the tee element includes a vertical portion and a horizontal portion, and the vertical portion includes a pair of aligned apertures for selectively aligning with a desired pair of the plurality of pairs of aligned apertures of the post for varying the height of the tee element in order to vary the force of the tension springs.

4. The apparatus of claim 1 in which the post and the tee element both include flat portions for preventing the rotational movement of the tee element and the tension springs relative to the foot pedals.

5. The apparatus of claim 1 in which the post includes a pair of aligned apertures, and the vertical portion of the tee element includes a plurality of aligned apertures for varying the height of the tee element to vary the force of the tension springs.

6. The apparatus of claim 1 in which the post is removable from the base element for storage and transport.

7. The apparatus of claim 1 in which the post is pivotly secured to the base, and the base includes a bottom recess for receiving the horizontal portion of the tee element for storage and transport when the post is pivoted on the base.

8. The apparatus of claim 7 in which the base includes a slot and a rod and the post is pivotly secured to the rod and the post is disposed in the slot for exercising a user's feet and legs, and the post is pivoted on the rod and out of the slot for storage and transport.

9. The exercise apparatus of claim 1 which further includes a motor and a first cam rotatingly secured to the motor, and the first cam moves the first pedal downwardly against the force of the first tension spring.

10. The exercise apparatus of claim 9 which further includes a second cam rotatingly secured to the motor, and the second cam moves the second pedal downwardly against the force of the second tension spring.

11. The exercise apparatus of claim 10 in which the second cam is disposed one hundred eighty degrees from the first cam.

12. Apparatus for contracting and expanding a user's calf muscles for pumping blood to the heart comprising in combination:

a base element;

a first pedal pivotly secured to the base element;

a second pedal pivotly secured to the base element;

a post extending vertically on the base element remote from where the first and second pedals are pivotly secured to the base element;

a tee element vertically adjustable relative to the post, said tee element including a vertically oriented section and a horizontally oriented section;

a first tension spring disposed between said horizontally extending section of the tee element and the first pedal to provide an upward bias force to move the first pedal upwardly; and a second tension spring disposed between the tee element and the second pedal to provide an upward bias force to move the second pedal upwardly.

13. The apparatus of claim 12 in which the tee element is telescopingly adjustable relative to the post.

14. The apparatus of claim 12 in which the post is removable from the base element for storage and transport.

15. The apparatus of claim 12 in which the post is pivotly secured to the base, and the base includes a bottom recess for receiving the horizontal portion of the tee element for storage and transport when the post is pivoted on the base.

16. The exercise apparatus of claim 12 which further includes a motor and a first cam rotatingly secured to the motor, and the first cam moves the first pedal downwardly against the force of the first tension spring.

17. The exercise apparatus of claim 16 which further includes a second cam rotatingly secured to the motor, and the second cam moves the second pedal downwardly against the force of the second tension spring.

18. The exercise apparatus of claim 17 in which the second cam is disposed one hundred eighty degrees from the first cam.

19. The apparatus of claim 1 in which the tee element is telescopically adjustable relative to the past.

* * * * *